US008720610B2

(12) United States Patent
Lanning et al.

(10) Patent No.: US 8,720,610 B2
(45) Date of Patent: May 13, 2014

(54) RESILIENT BIT SYSTEMS AND METHODS

(71) Applicant: National Oilwell Varco, L.P., Houston, TX (US)

(72) Inventors: Curtis Clifford Lanning, Montgomery, TX (US); Aaron E. Schen, Spring, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 13/724,456

(22) Filed: Dec. 21, 2012

(65) Prior Publication Data

US 2013/0112486 A1 May 9, 2013

Related U.S. Application Data

(62) Division of application No. 12/544,306, filed on Aug. 20, 2009, now abandoned.

(60) Provisional application No. 61/112,075, filed on Nov. 6, 2008.

(51) Int. Cl.
*E21B 10/46* (2006.01)
*E21B 10/00* (2006.01)

(52) U.S. Cl.
USPC ..... 175/382; 175/426

(58) Field of Classification Search
USPC ..... 175/426, 425, 327, 382
See application file for complete search history.

(56) References Cited

U.S. PATENT DOCUMENTS

| | | | | | |
|---|---|---|---|---|---|
| 1,897,785 | A | * | 2/1933 | Bascom Calvin P et al. | 175/392 |
| 1,940,890 | A | * | 12/1933 | Stokes John C | 279/105 |
| 1,969,040 | A | * | 8/1934 | Sanderson Ray R | 175/413 |
| 2,644,670 | A | * | 7/1953 | Baker John R et al. | 175/426 |
| 2,693,938 | A | * | 11/1954 | Roberts Harry E | 175/397 |
| 2,803,435 | A | * | 8/1957 | Kammerer, Jr Archer W | 175/413 |
| 2,894,726 | A | * | 7/1959 | Weaver Earl M et al. | 175/391 |
| 3,052,310 | A | * | 9/1962 | Kinzbach Robert B | 175/406 |
| 3,059,708 | A | * | 10/1962 | Cannon George E et al. | 175/393 |
| 3,075,594 | A | * | 1/1963 | Creel Ernest S | 175/412 |
| 3,526,049 | A | * | 9/1970 | Nichols Irvin H | 37/457 |
| 4,499,958 | A | * | 2/1985 | Radtke et al. | 175/428 |
| 4,605,157 | A | | 8/1986 | Barr et al. | |
| 4,711,144 | A | | 12/1987 | Barr et al. | |
| 5,147,001 | A | * | 9/1992 | Chow et al. | 175/428 |
| 5,560,440 | A | | 10/1996 | Tibbitts | |
| 6,102,142 | A | | 8/2000 | Besson et al. | |

(Continued)

OTHER PUBLICATIONS

Office Action Dated Feb. 10, 2012; U.S. Appl. No. 12/544,306 (7 p.).

(Continued)

*Primary Examiner* — Jennifer H Gay
(74) *Attorney, Agent, or Firm* — Conley Rose, P.C.

(57) ABSTRACT

A drill bit for subsurface drilling includes a body; a blade extending from the body and having a front, a back side, and a formation facing surface between the front side and the back side. The blade is configured to have a plurality of cutting elements mounted to it. In addition the drill bit includes a first flex cut extending into the blade from the formation facing surface and positioned between the front side and the back side of the blade. The first flex cut is configured to allow at least a portion of the blade to flex.

14 Claims, 17 Drawing Sheets

(56) References Cited

U.S. PATENT DOCUMENTS

| | | | | |
|---|---|---|---|---|
| 6,142,250 | A | 11/2000 | Griffin et al. | |
| 6,298,930 | B1 | 10/2001 | Sinor et al. | |
| 6,460,631 | B2 | 10/2002 | Dykstra et al. | |
| 6,739,214 | B2 | 5/2004 | Griffin et al. | |
| 6,779,613 | B2 | 8/2004 | Dykstra et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 6,935,441 | B2 | 8/2005 | Dykstra et al. | |
| 7,036,613 | B2 | 5/2006 | Burr | |
| 7,096,978 | B2 | 8/2006 | Dykstra et al. | |
| 7,237,628 | B2 | 7/2007 | Desai et al. | |
| 7,318,492 | B2 | 1/2008 | Watson et al. | |
| 7,571,782 | B2 * | 8/2009 | Hall et al. | 175/432 |
| 7,814,990 | B2 | 10/2010 | Dykstra et al. | |
| 7,878,275 | B2 * | 2/2011 | Lockwood et al. | 175/425 |
| 8,066,084 | B2 | 11/2011 | Dykstra et al. | |
| 8,079,431 | B1 | 12/2011 | Cooley et al. | |
| 8,210,288 | B2 * | 7/2012 | Chen et al. | 175/430 |
| 8,272,458 | B2 * | 9/2012 | Nackerud | 175/416 |
| 8,312,941 | B2 * | 11/2012 | Mirchandani et al. | 175/327 |
| 8,347,990 | B2 * | 1/2013 | Lockwood et al. | 175/425 |
| 8,459,382 | B2 * | 6/2013 | Aliko et al. | 175/408 |
| 2001/0030063 | A1 | 10/2001 | Dykstra et al. | |
| 2003/0029642 | A1 | 2/2003 | Dykstra et al. | |
| 2004/0216926 | A1 | 11/2004 | Dykstra et al. | |
| 2005/0284660 | A1 | 12/2005 | Dykstra et al. | |
| 2006/0278436 | A1 | 12/2006 | Dykstra et al. | |
| 2007/0187153 | A1 * | 8/2007 | Bertagnolli | 175/374 |
| 2007/0205023 | A1 * | 9/2007 | Hoffmaster et al. | 175/408 |
| 2008/0230278 | A9 * | 9/2008 | Hoffmaster et al. | 175/408 |
| 2008/0289880 | A1 | 11/2008 | Majagi et al. | |
| 2009/0120693 | A1 | 5/2009 | McClain et al. | |
| 2010/0089664 | A1 | 4/2010 | Welch et al. | |
| 2010/0108401 | A1 | 5/2010 | Lanning et al. | |
| 2011/0005837 | A1 * | 1/2011 | Hoffmaster et al. | 175/57 |
| 2011/0100721 | A1 * | 5/2011 | Aliko et al. | 175/331 |
| 2011/0114392 | A1 | 5/2011 | Dykstra et al. | |
| 2012/0024609 | A1 | 2/2012 | Dykstra et al. | |

OTHER PUBLICATIONS

Response to Office Action Dated Feb. 10, 2012; U.S. Appl. No. 12/544,306; Response Filed Jul. 26, 2012 (16 p.).

Final Office Action Dated Aug. 23, 2012; U.S. Appl. No. 12/544,306 (8 p.).

Restriction Requirement Dated Dec. 13, 2011; U.S. Appl. No. 12/544,306 (5 p.).

Response to Restriction Requirement Dated Dec. 13, 2011; U.S. Appl. No. 12/544,306; Response Filed Jan. 12, 2012 (9 p.).

* cited by examiner

Prior Art

RESILIENT BIT SYSTEMS AND METHODS

CROSS REFERENCE TO RELATED APPLICATIONS

This application is a divisional of U.S. application Ser. No. 12/544,306 filed Aug. 20, 2009, which claims the benefit of U.S. Provisional Application No. 61/112,075 filed Nov. 6, 2008, both of which are hereby incorporated herein by reference in its entirety for all purposes.

FIELD

The present invention is generally related to the field of drill bits used in drilling oil, gas, water wells and horizontal boring.

BACKGROUND

Subsurface wells can be formed by a rotary drilling process. To that end, a drill bit is mounted on the end of a drill string which may be very long, e.g., several thousand feet. At the surface, a rotary drive mechanism turns the drill string and the attached drill bit at the bottom of the hole. In some cases, a downhole motor may provide the desired rotation to the drill bit. During drilling operations, a drilling fluid ("drilling mud") can be pumped through the drill string and back uphole by pumps located on the surface. The purpose of the drilling fluid is to, among other things, remove the subsurface formation cuttings resulting from the drilling process.

There are two basic types of boring drill bits commonly used to form the subsurface boreholes for exploration and recovery applications. The first utilizes one or more rolling cutters mounted on a bit body. There are typically several rows of cutting teeth on each cutter. When the bit body is rotated and weight is applied, the teeth on the cutters engage the formation causing the cutters to rotate. As the cutters rotate, the teeth are sequentially pushed into the formation effecting a drilling action. These bits are commonly known as rolling cutter drill bits or rock bits.

The second type of subsurface boring bit utilizes cutting elements fixed on the blades of the bit body. These bits are also rotated, and when weight is applied, the cutting elements are pushed into, and dragged through the formation. This dragging action causes formation removal by shearing. These types of drill bits are generally known as fixed cutter (FC) drill bits.

There are different FC drill bit designs for different drilling applications. For example, a high bladed steel bit (often called a fishtail bit) may be suitable for rapidly drilling through very soft soils and formations, while a polycrystalline diamond compact (PDC) bit may be used to drill through harder rock formations. For very hard and tough rock formations, an infiltrated tungsten-carbide matrix bit body is employed with diamond cutting elements. These are typically called diamond or natural diamond drill bits.

As a general rule, drill bits that are able to drill rapidly through soft formations cannot penetrate the harder formations and, similarly, drill bits that are able to drill through harder formations are not aggressive enough to economically drill through softer formations. Thus, when drilling deep wells through many different types of rock and soil, drill bits may have to be changed many times in response to wear or in response to changing soil conditions.

Common to all types of subsurface drilling bits is a means to flush the drilled formation fragments away from the cutting interface and transport them to the surface. For shallow boreholes, air is a suitable flushing fluid. However, for the deep boreholes commonly drilled for the exploration and production of hydrocarbons, the flushing fluid is typically drilling mud. Although the type of drilling fluid may vary, it typically contains abrasive elements, and it is usually pumped through nozzle orifices on the drill bit.

In rolling cutter drill bits, the primary role of drilling mud is to clean the bit and the bottom of the boreholes and transport the cuttings to the surface. In fixed cutter drill bits with PDC elements, however, the drilling mud has an added role of cooling the PDC diamonds. Diamond and other suitable forms of superhard materials are much harder than the formations being drilled, so theoretically these materials should not exhibit any wear. However, it is apparent from examination of used drill bits that the superhard cutting elements do degrade. The degradation of the superhard cutting elements can be caused by various factors.

Drilling inherently generates a significant amount of vibration as well as high forces that are necessary to efficiently fail rock. However, excessively high loading leads to premature cutter failure and expensive trips/repairs. There have been many different attempts to address these problems. For example, one conventional method to provide erosion resistance is to apply welded hardmetal in thick layers to the surface of the blades of a steel body drill bit. Unfortunately, welded hardmetal can crack as the blades of the PDC drill bit bend in response to the drilling loads. Once a crack starts, the impinging drilling fluid quickly erodes the exposed, soft underlying steel. Conventional bit designs are described in U.S. Pat. Nos. 7,318,492, 7,237,628, 7,036,613, 6,878,447, 6,861,137, 6,861,098, 6,797,326, and 6,739,214 (all assigned to the present assignee and each entirely incorporated herein by reference).

There remains a need for improved bit designs to provide increased resiliency and structure durability.

SUMMARY

In accordance with the embodiments of the present invention, drill bit configurations are disclosed that have a substantially more resilient cutting structure.

Disclosed herein is a drill bit apparatus including: a bit body that is configured to sustain at least one blade, or portion of one blade; and a material that is disposed between the at least one blade and the bit body, wherein the material allows the blade to deflect while sustained by the bit body. In an aspect, the blades are not an integral part of the bit body. In an embodiment, the material that is disposed between the at least one blade and the body is an absorbing layer. This absorbing layer acts as a vibration/force absorption device, specifically high force vibration caused by impact loading, which leads to substantially less cutter damage and increased bit life.

Also disclosed herein is a drill bit apparatus including a body that is configured with at least one blade, or portion of one blade, wherein the body is configured with a void space to permit the at least one blade, or portion of one blade, to flex. Such a design provides an independent suspension for portions of the blades, which are allowed to flex away from the drilling force during extreme drilling conditions. The flexible properties of the blade, or portion of blade, reduces the force on the cutters directly. In these embodiments, the geometry of the bit body itself provides absorption capabilities.

Additionally disclosed herein is a method for producing a drill bit for subsurface drilling including the steps of: configuring a body to sustain at least one blade, or portion of one blade; and disposing a material between the at least one blade, or portion of a blade, and the body, wherein the material allows the blade, or portion of one blade, to deflect while sustained by the body. In an aspect, the material is placed via molding into a groove in the bit body that supports the blade.

Further disclosed herein is a method for producing a drill bit for subsurface drilling including the steps of: configuring a bit body having at least one blade, or portion of one blade; and configuring the bit body with a void space to permit the at least one blade, or portion of one blade, to flex. In an aspect, the bit body is configured by cutting a segment into the bit body, resulting in the void space that permits the at least one blade, or portion of a blade, to flex.

The preceding has outlined rather broadly the features and technical advantages of the present invention in order that the detailed description of the invention may be more fully understood. The features and technical advantages of the present invention will be readily apparent to those skilled in the art upon a reading of the detailed description of the embodiments of the invention, which follows.

DETAILED DESCRIPTION

Figure 3:
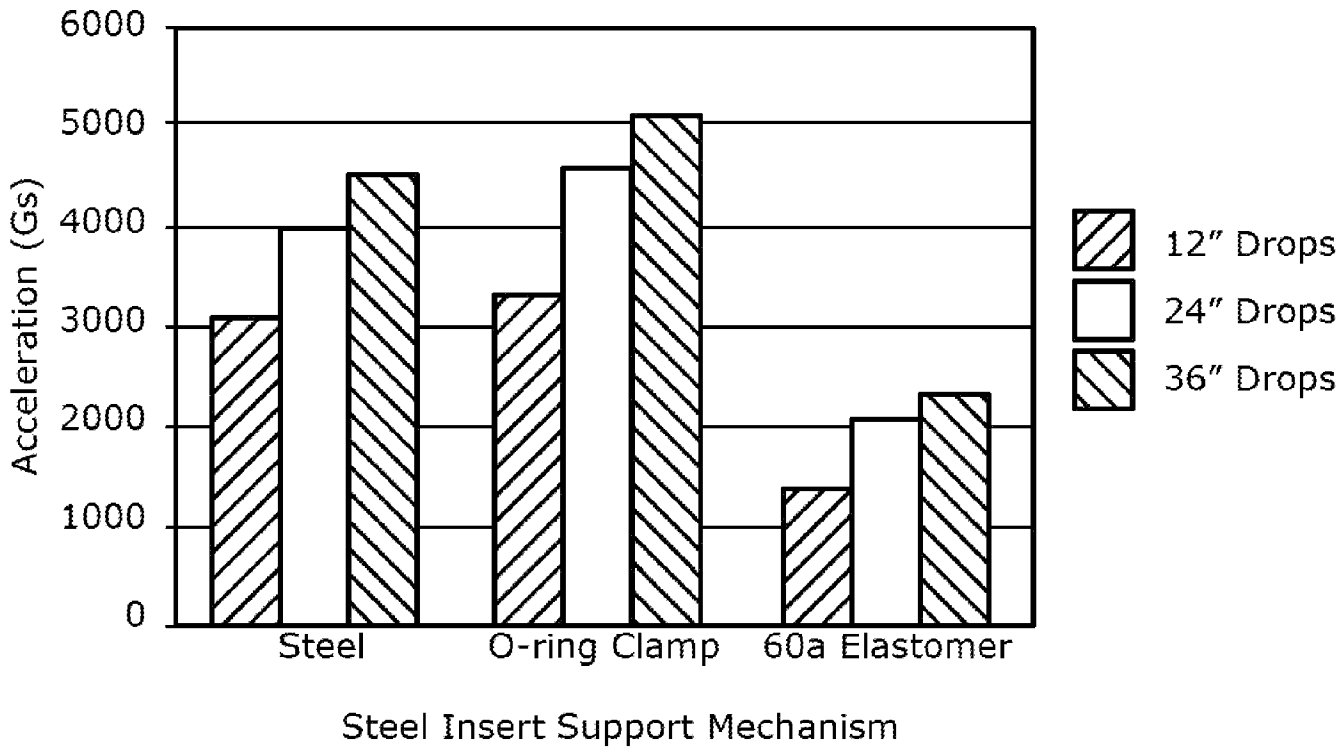
FIG. 3 is a plot illustrating the results from laboratory drop testing of cutters using different support mechanisms, including aspects of the invention.
Figure 4:
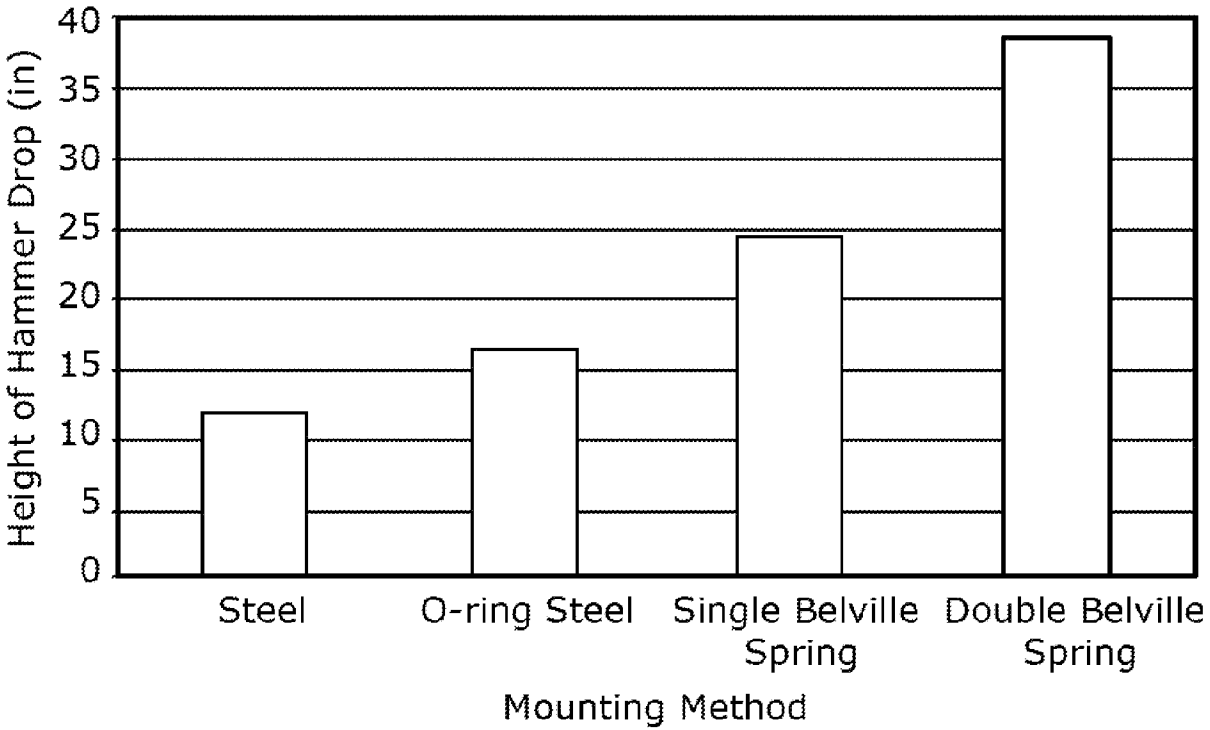
FIG. 4 is a plot illustrating the results from laboratory drop testing of cutters using different support mechanisms.

A laboratory hammer drop testing of diamond cutters using different support mechanisms was performed. The results from this testing showed that cutters supported by a dampening mechanism sustained hammer impact drops from higher heights than those supported with a rigid structure, and thus would sustain greater forces than the rigid structure. FIGS. 3 and 4 illustrate the results from laboratory hammer impact drop testing of cutters using different support mechanisms. Cutters supported on a rigid structure exhibited failure after impact with a hammer falling from a height of 12 inches, while cutters supported by a dampening mechanism exhibited failure at falling hammer heights ranging from 16 to 38 inches.

Certain aspects of the present invention disclose configurations for drill bits wherein the addition of a vibration absorbing material (e.g. an elastomer) produces a substantially more resilient cutting structure. One aspect includes a bit in which the blades are not an integral part of the bit body. In this aspect, the blades are flexibly supported by an absorbing layer that can be disposed (e.g., via molding) between the blade and the bit body. The interface between the blade and bit body can be configured with features to optimize blade displacement, absorb material stress levels, and provide additional retention. The absorbing material can act as a dampening, a spring/elastic mechanism, and/or can act as a vibration/force absorption device, specifically high force vibration caused by impact loading, which leads to substantially less cutter damage and increased bit life.

The drill bits of the current invention include standard drag bits, core bits underreamers, bicenters, reamers, fixed cutter (FC) drill bits, and the like. Examples of FC drill bit designs include, inter alia, a high bladed steel bit (or fishtail bit), a polycrystalline diamond compact (PDC) bit, and an infiltrated tungsten-carbide matrix bit body. The bit body of the current invention may be made from any suitable material such as steel or matrix body or combinations thereof.

In an embodiment, the vibration absorbing material includes a polymeric component. In an aspect the polymeric component is an elastomer. Examples of elastomers include, but are not limited to natural rubber, synthetic polyisoprene, butyl rubber, polybutadiene, styrene-butadiene rubber, nitrile rubber, nitrile butadiene rubber, EPM (ethylene propylene rubber, a copolymer of ethylene and propylene), polyacrylic rubber, silicone rubber, ethylene-vinyl acetate, thermoplastic elastomers, thermoplastic polyurethane, thermoplastic olefins, polysulfide rubber and combinations thereof.

In an embodiment, the absorbing layer can be disposed via casting, molding, extrusion, or the like. Examples of molding processes include extrusion molding, injection molding, dip molding and the like.

Figure 1:
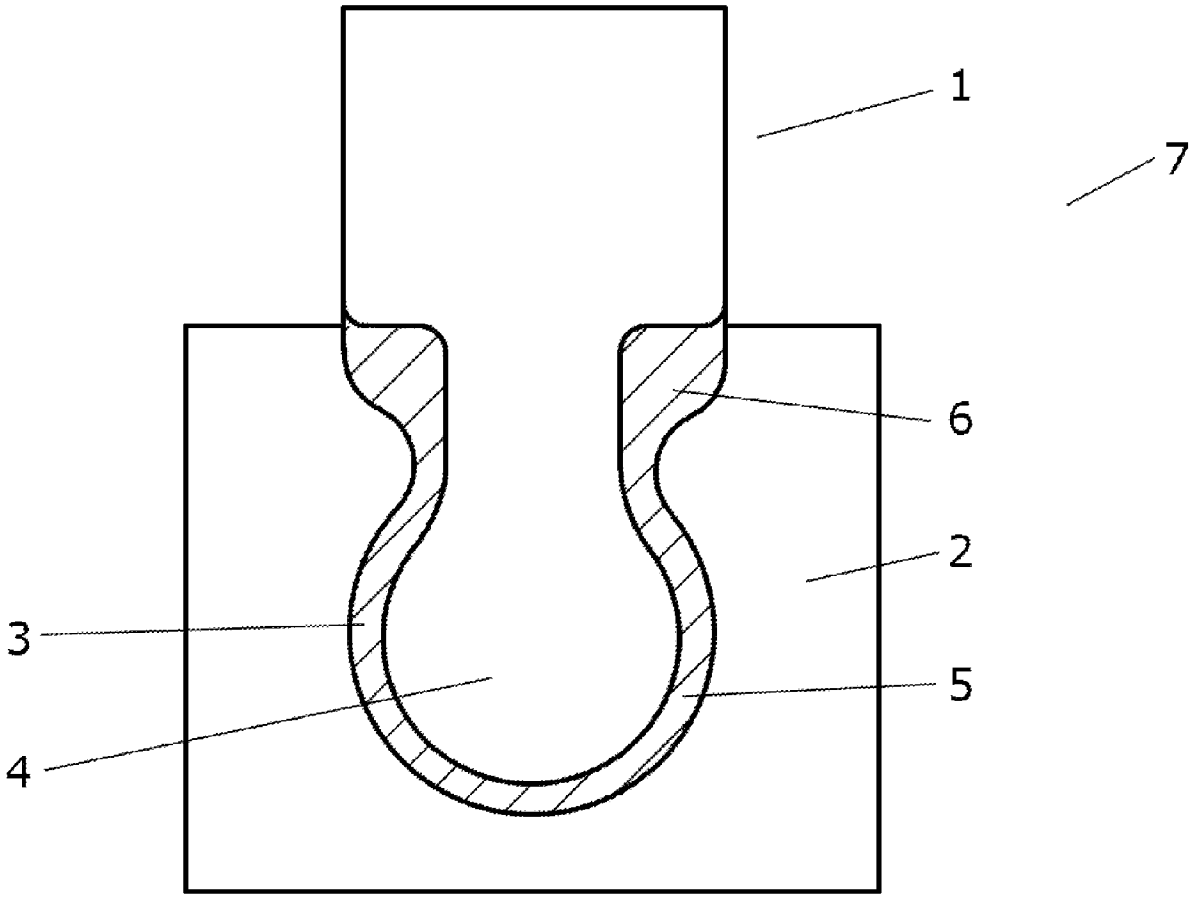
FIG. 1 illustrates a cross-sectional view of a bit, blade and absorbing material cavity as assembled having a circular geometry cut.

FIG. 1 shows one aspect of the invention in which a blade 1 and a bit 2 are attached by a circular geometry cut 3 into the bit 2 that includes a secondary blade retention configuration 4. A remaining void space 5 results from the circular geometry. The remaining void space 5 can be filled with a durable absorbing material 6 that reduces the impact forces on the cutting elements. This configuration as combined results in the force absorbing assembly 7. The assembly 7 allows for deflection and increased torque resistance. The taper of the geometry cut 3 and the secondary blade retention configuration 4 can be optimized to achieve the minimum required absorbing material 6 surface area and volume to support the load impacts that the assembly will be subjected to under drilling operations. The taper design can also enable more void surface area near the outside of the bit than near the inside of the bit, which can provide more blade movement while still securing the blade within the bit. Referring to FIG. 1, there can be seen a larger void 5 and therefore more absorbing material 6 near the top of the bit 2 as oriented, as compared to the areas near the lower portion of the bit where in the bottom of the secondary blade retention configuration 4 is closer to the edge of the geometry cut 3. This can enable the blade 1 to pivot to some degree within the bit 2 when placed under a impact loading.

In an embodiment the taper of the geometry cut within the bit and the secondary blade retention configuration is optimized to minimize the absorbing material surface area and volume required to support the design load impact of the assembly. Other aspects may be implemented to contain many different shapes/sizes of varying complexities, each aimed at optimizing the bit's ability to absorb additional loading. For example, the circular geometry cut into the bit and corresponding secondary blade retention configuration may be replaced by the geometries of a triangle, square, rectangle, etc. Each assembly should provide sufficient strength to support the high loading associated with drilling as well as resistance to drilling fluids and downhole temperature/pressure. Any suitable material that can withstand the downhole environment as known in the art may be used for the absorbing material. In an embodiment, one or more blades contain at least one force absorbing assembly 7. In another embodiment, one or more blades contain two to five force absorbing assemblies.

Figure 2:
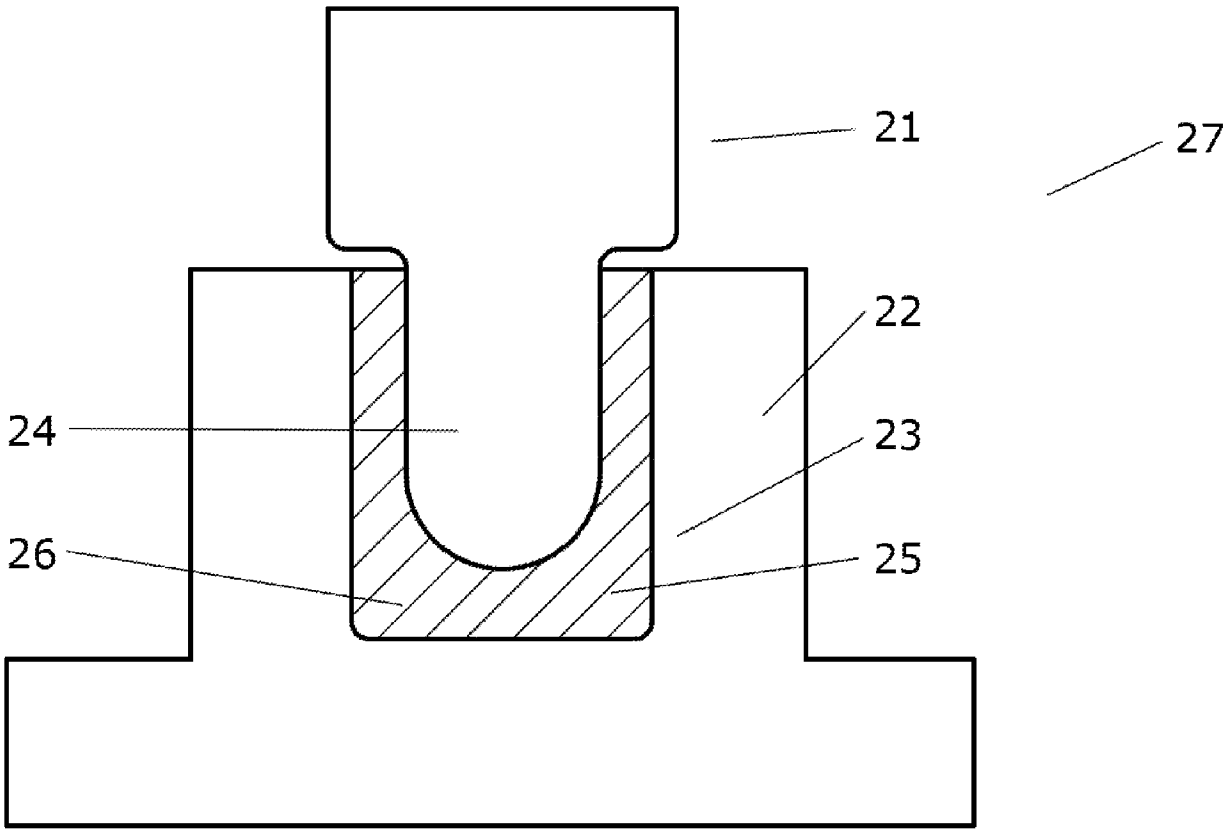
FIG. 2 illustrates a cross-sectional view of the bit, blade and absorbing material cavity as assembled having a square geometry cut.

FIG. 2 shows another aspect of the invention in which the circular geometry cut is replaced with a square geometry cut 23. Here, a blade 21 and a bit 22 are attached by a square geometry cut 23 into the bit 22 that includes a secondary blade retention configuration 24 corresponding to the square geometry cut 23. A remaining void space 25 results from the circular geometry. The remaining void space 25 is filled with a durable absorbing material 26 that reduces the impact forces on the cutting elements. This configuration as combined results in the force absorbing assembly 27. In an embodiment, each blade contains at least one force absorbing assembly 27. In another embodiment, each blade contains two to five force absorbing assemblies.

FIG. 3 is a plot illustrating the results from laboratory hammer drop testing of cutters using different support mechanisms, including aspects of the invention. Cutters supported by absorbing materials (e.g., elastomers) in accordance with aspects of the invention sustained approximately fifty percent (50%) less acceleration/force than rigidly mounted cutters. That result was also manifested in destructive testing where traditionally mounted cutters failed significantly before the disclosed cutter designs.

Additional embodiments of the invention include methods of producing a drill bit having cutters supported by absorbing materials. The methods of the present invention may include the steps of: cutting a void space into a bit body; configuring a blade having a retention configuration; placing the retention configuration into a portion of the void space in the bit body; and injecting a material to fill the remaining void space. The methods of the present invention may also include the steps of: cutting a void space into a bit body; configuring a blade having a retention configuration; placing the retention configuration into a portion of the void space in the bit body; molding an absorbing material to fit the remaining void space of the bit body; adding an adhesive to the absorbing material; and connecting the absorbing material to the void space of the bit body and the piece of the blade.

Other aspects of the invention provide bit designs for drill bits such that the blade is mechanically resilient. During drilling, high vibration is partially absorbed or dampened by the bit, thus leading to a substantially more resilient cutting structure and enhanced durability. Aspects include a bit in which the blades provide the cutters (e.g., PDC cutters) with more independent suspension. The blades or portions of the blades are allowed to flex away from the drilling force during extreme drilling conditions to reduce the force imparted on the cutters directly. This is done through use of the energy absorption capabilities of the bit body itself. The bit geometries include features to optimize blade displacement as well as bit body maximum stress. Primarily, the blade acts as a vibration/force absorption device, specifically high force vibration caused by impact loading, which leads to substantially less cutter damage and increased bit life.

Figure 5:
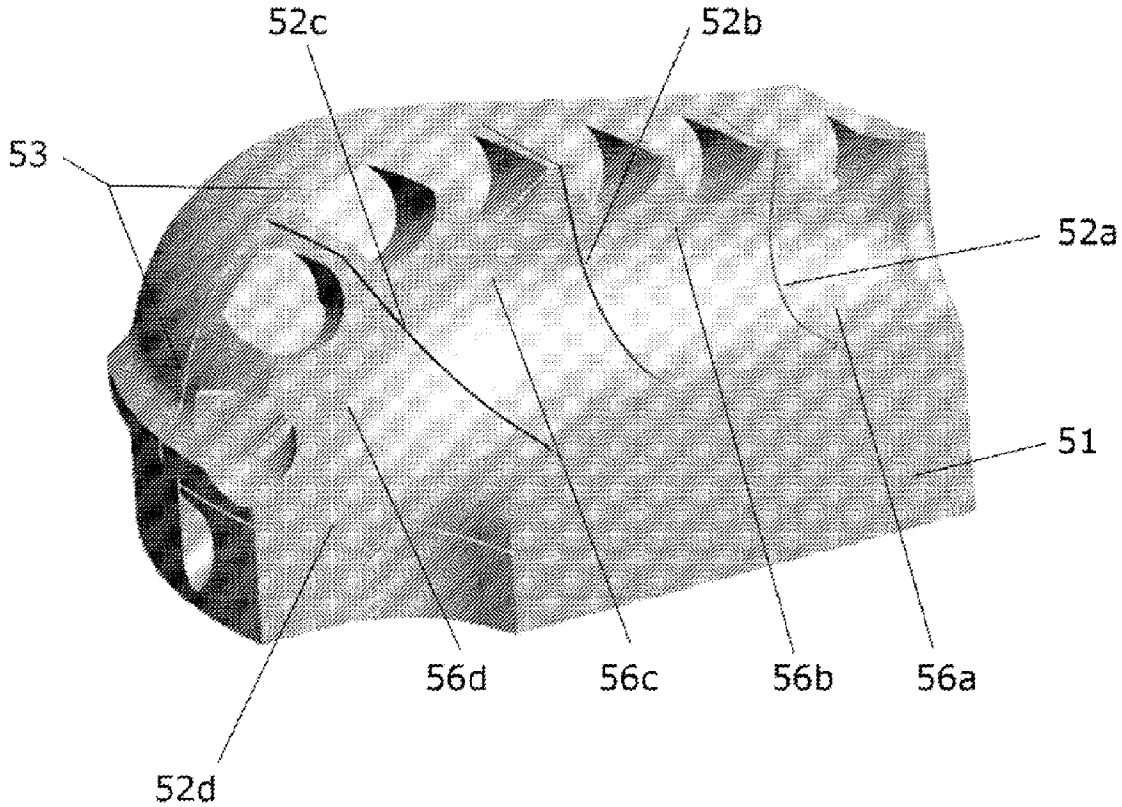
FIG. 5 illustrates an aspect of a blade having a vibration/force absorbing geometry according to the invention.

FIG. 5 shows an aspect of a blade having a vibration/force absorbing geometry according to the invention. FIG. 5 depicts a portion of a solid bit body 51, having decoupling cuts (52*a,b,c,d*) and flex cuts (53), The decoupling cuts generally run from the front of the blade toward the back of the blade and serve to decouple portions of the blade into segments (56*a,b,c,d*). The decoupling cuts do not have to proceed through the back of the blade. In one embodiment the decoupling cuts can segment a portion of the blade, but not cut into a different portion, such as a portion behind the segmented portion that can be utilized as a backstop to restrict the movement of the segmented portions. The flex cuts are cuts located behind the front side of a blade and between two or more decoupling cuts that with the decoupling cuts form at least one segment. These cuts reduce the blade stiffness to allow the resulting segment of the blade to act as a beam that has the capacity for limited bending from front to back.

Figure 6A:
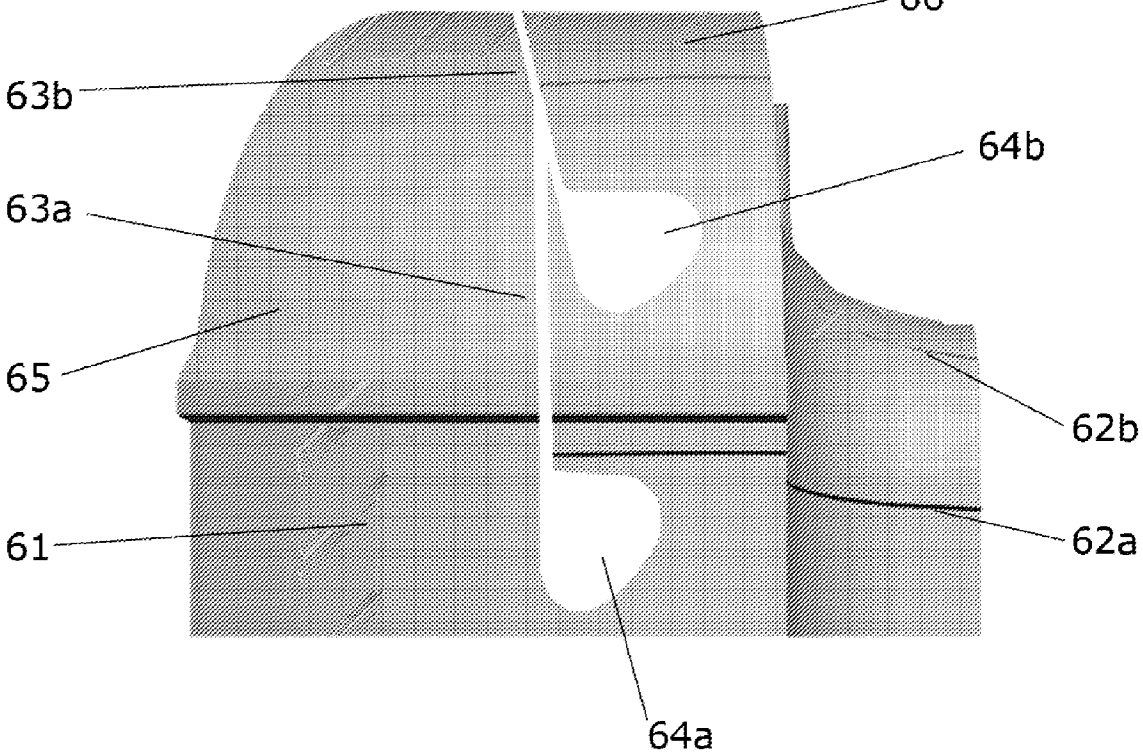
FIGS. 6*a* and 6*b* illustrate a side profile of a blade having a vibration/force absorbing geometry contained therein according to the invention.
Figure 6B:
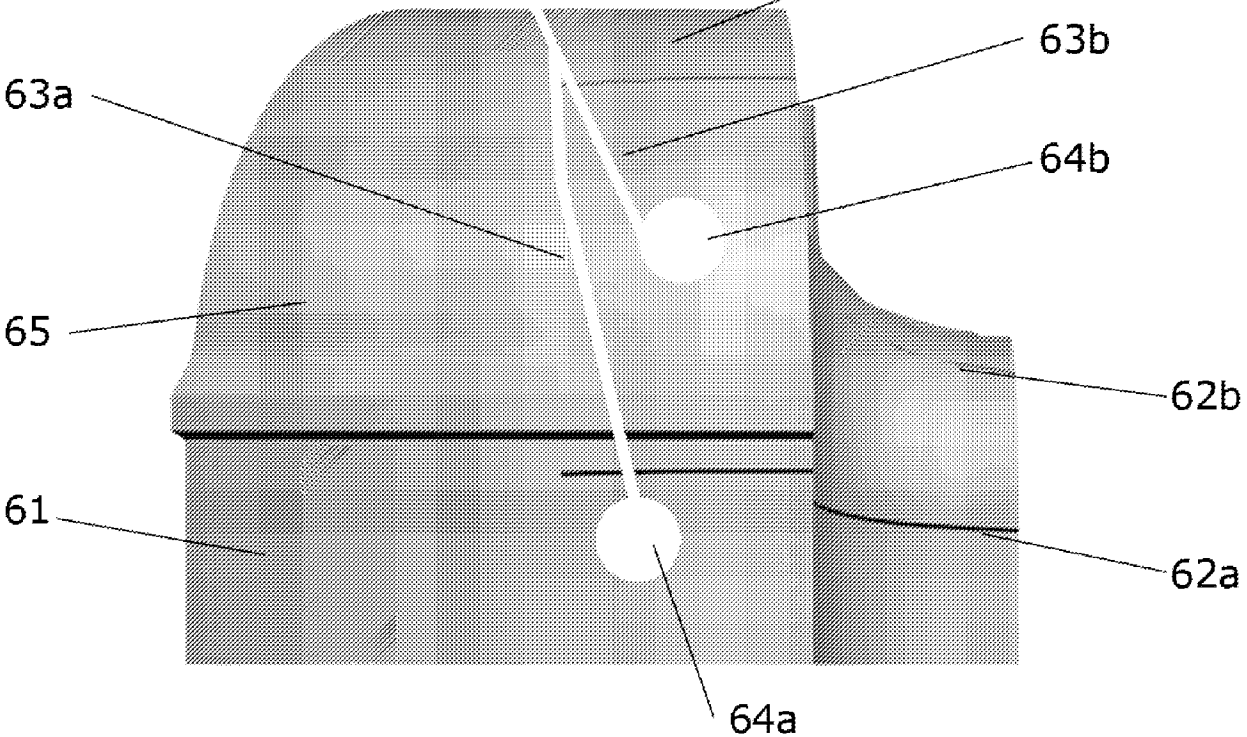

FIGS. 6*a* and 6*b* presents illustrations of blade designs having a vibration/force absorbing geometry according to the invention. A solid bit body 61, having decoupling cuts (62*a, b*), flex cuts (63*a,b*), void cuts (64*a,b*) and a backstop 65 are shown. The illustrations of flex and void cuts are to present possible locations which can extend to the end of the body but may also not extend to the exposed end of the body and may be located within the bit body behind only one or more of the various segments. Flex cuts are cuts located behind the front side of a blade and between two or more decoupling cuts to form at least one segment. The cuts reduce the blade stiffness to allow the resulting blade segments 66 to act as a beam that has the capacity for limited movement from front to back. There can be one or more flex cuts, as for instance both 63*a* and 63*b* in FIGS. 6*a* and 6*b*. The flex cut of each segment may be different. The backstop 65 is a rigid fixed part of the bit blade. The backstop acts to limit the movement, or the amount of flex, of the segments. The design of the segment and backstop can limit the movement of the segment to less than the elastic limit of the blade material. In an embodiment, each blade contains at least one segment. In another embodiment only a portion of the blades of a bit contains at least one segment. In another embodiment, each blade contains 4 to 20 segments. In an embodiment at least one segment contains at least one cutter. In a further embodiment, at least one cutter is present on each segment. In another embodiment, at least one segment contains 2 or more cutters.

While each design has certain inherent dynamic characteristics, each achieves similar core benefits. The void cut is a gap, opening, channel, or void created by the removed bit material. The void cut may be any suitable shape or design, including, but not limited to, an oval, an ellipse, a banana shape, etc. The void cut may be left to fill with drilling fluids during use or may be filled with a filler material (e.g., an elastomer) if desired in order to prevent cuttings from filling the void, or to inhibit corrosion within the void area, and/or to generate additional vibration dampening. Any suitable material that can withstand the downhole environment as known in the art may be used for the filler material.

In other embodiments, the backstop may contain its own flex cut. This second flex cut serves to increase the dampening effect of the bit design. The dampening effect of the second flex cut supplements the dampening effect of the first flex cut. In an embodiment, the backstop may contain more than one flex cut. The backstop may be part of the original bit body or may be added (e.g., by welding) after the cuts are made. The backstop may also be of a different material than the blade and/or bit body. In an embodiment, the blade includes steel and the backstop and bit body are made from a matrix body.

the rate of flex of the flexible segment of the blade depends upon the material chosen for the bit and/or blade and thickness and geometry of the flexible segment of the blade. The flexible segment may be designed such that it does not flex during normal operating conditions. During operation, the flexible segment may be flexed, and after operation, the flexible segment returns to its original position. During operation, the flexible segment may be flexed to the extent that it does not return to its original position after operation, resulting in a permanent deformation. The thickness of the flex cut, the distance between the blade and the backstop, determines the degree of flex capable of the flexible segment. In a non-limiting example, the thickness of the flex cut ranges from 0.005 inch to 0.100 inch. The geometry of the flexible segment can be designed to maximize the stored strain energy in the flexible segment without exceeding the elastic limit of the material. In one embodiment the geometry of the flexible segment is designed to optimize the stored strain energy in the flexible segment to enable a desired degree of deflection while not exceeding the elastic limit of the material.

Figure 7A:
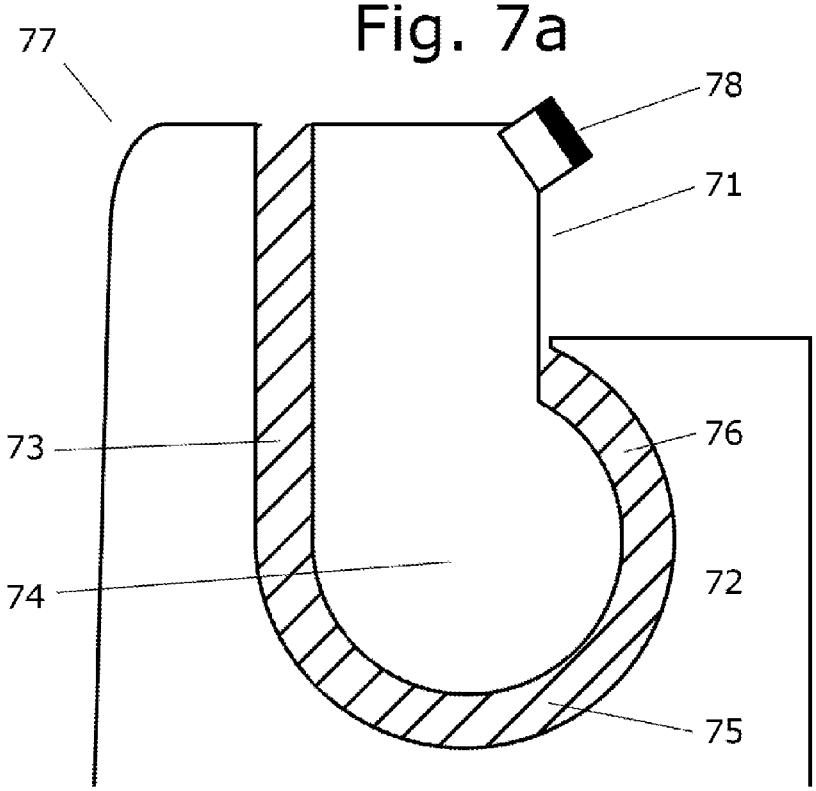
FIGS. 7*a* through 7*c* illustrate a side profile of various embodiments having vibration/force absorbing material cavity according to the invention.
Figure 7B:
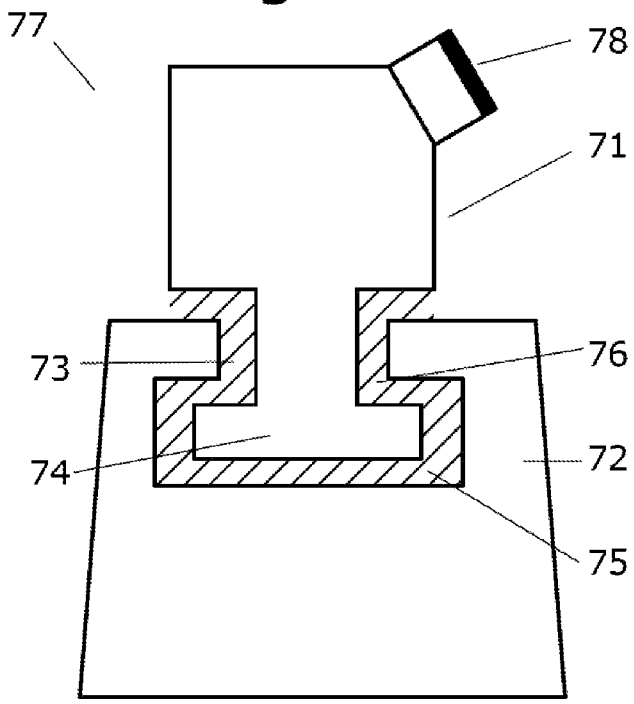
Figure 7C:
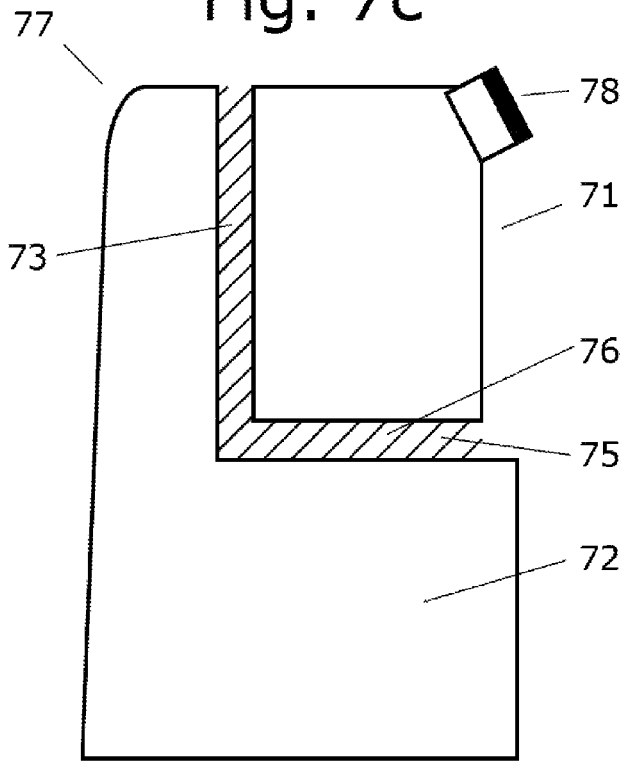
Figure 7D:
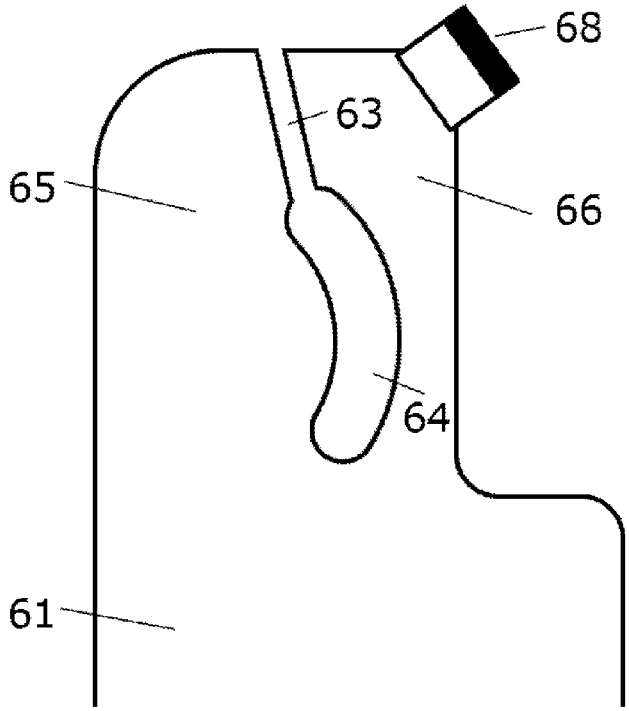
FIGS. 7*d* through 7*h* illustrate a side profile of embodiments having a vibration/force absorbing geometry according to the invention.
Figure 7E:
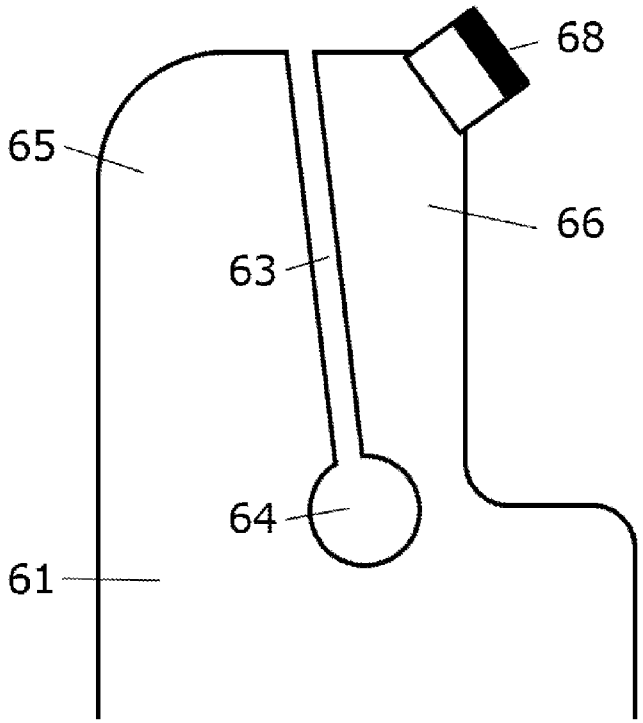
Figure 7F:
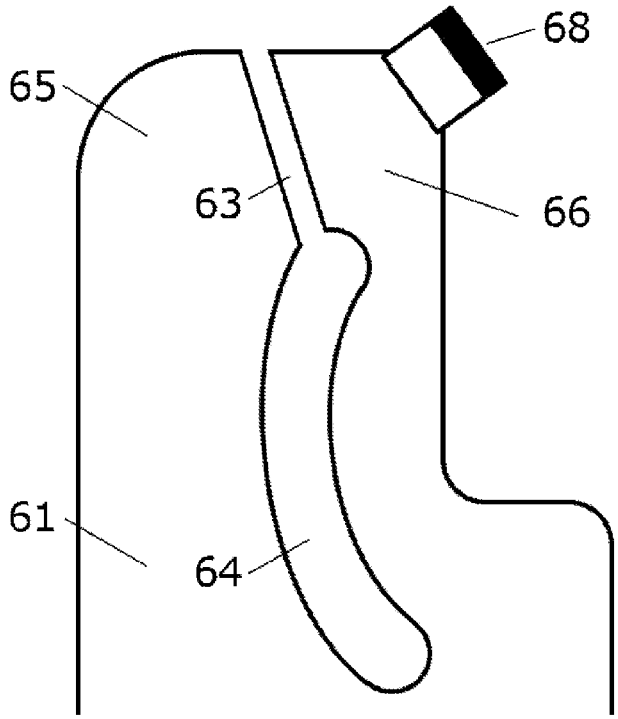
Figure 7G:
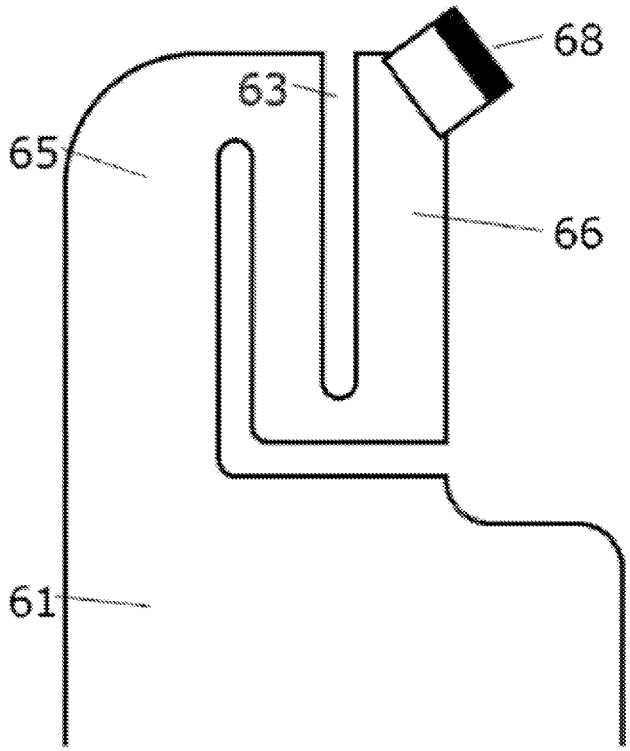
Figure 7H:
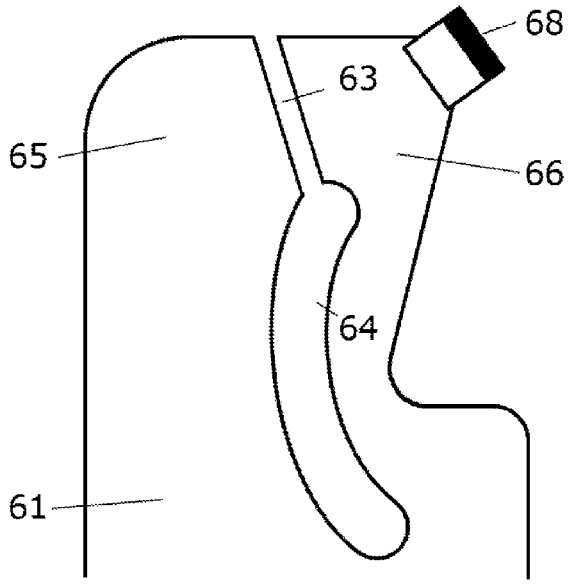

FIGS. 7*a* through 7*c* show alternate embodiments of the invention that are similar to those shown in FIGS. 1 and 2. A blade 71 and a bit 72 are attached by a geometry cut 73 into the bit 72 that includes a blade retention configuration 74 corresponding to the geometry cut 73. A remaining void space 75 results from the geometries. The remaining void space 75 is filled with a durable absorbing material 76 that reduces the impact forces on cutting elements 78. This configuration as combined results in the force absorbing assembly 77. In an embodiment, each blade contains at least one force absorbing assembly 77. In another embodiment, each blade contains two to five force absorbing assemblies.

FIGS. 7*d* through 7*h* show cross section views of alternate embodiments of the invention that are similar to those shown in FIGS. 6*a* and 6*b*. A solid bit body 61, having a flex cut 63, a void cut 64, a segment 66 holding a cutting element 68 and a backstop 65 are shown.

Other aspects of the flex-blade designs can be implemented with many different shapes/sizes of varying complexities, each aimed at optimizing the bit's ability to absorb additional loading from torque and/or weight on bit. Each aspect should provide sufficient strength to support the high loading associated with drilling.

Additional embodiments of the invention include methods of producing a drill bit having a flex-blade design. The methods of the present invention may include: cutting a flex cut located behind the front side of a blade; cutting a void cut located behind the front side of a blade; and cutting decoupling cuts from the front of a blade into the blade to intersect the void cut. The void cut enables the segmented section to act as a bending beam to allow a degree of flex of the blade from front to back. The cuts made in the present invention may be made by an electronic discharge machine (EDM), wherein a wire or electrode having a high charge is capable of burning through metal. In making the cuts of the invention, the EDM can enable cuts from one segment to intersect cuts from another segment. Other non-limiting means of making the cuts include laser, water jet, saw cut or milling operations.

Figure 8:
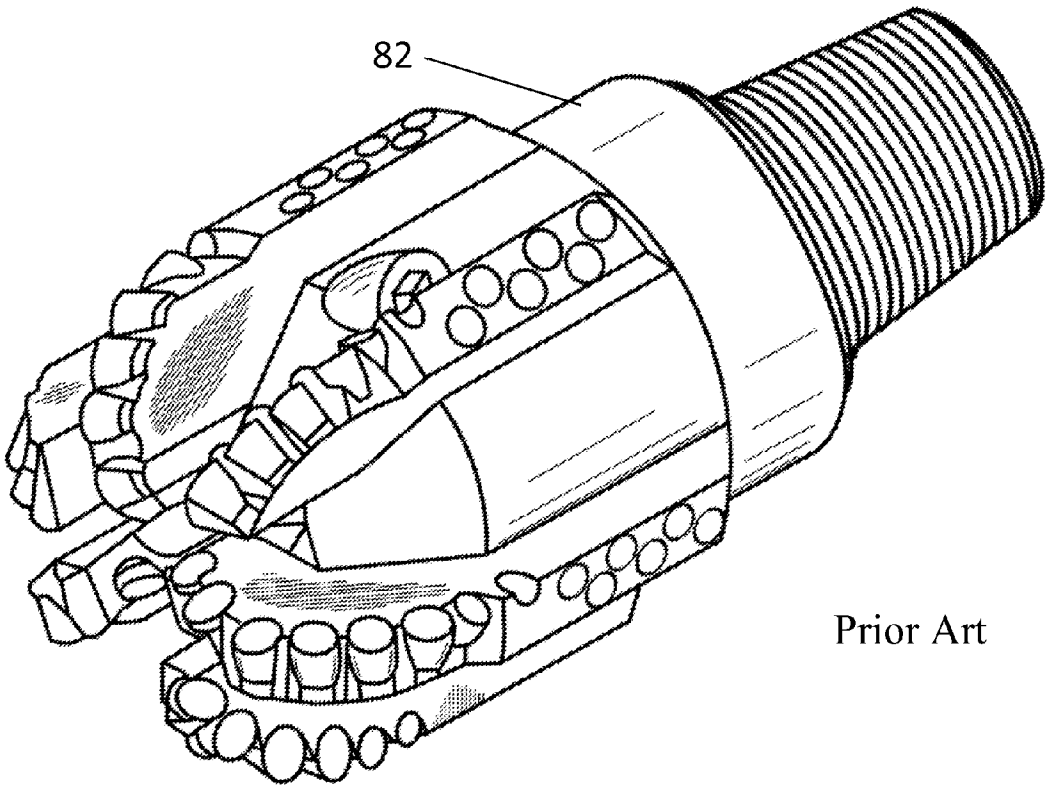
Fig. 8 Prior Art
FIG. 8 shows an embodiment of a conventional FC cutter rotary drill bit.

FIG. 8 shows a conventional fixed cutter rotary drill bit 82. Embodiments of the present invention can be used on the blades or portions of blades of a fixed cutter rotary drill bit.

Figure 9:
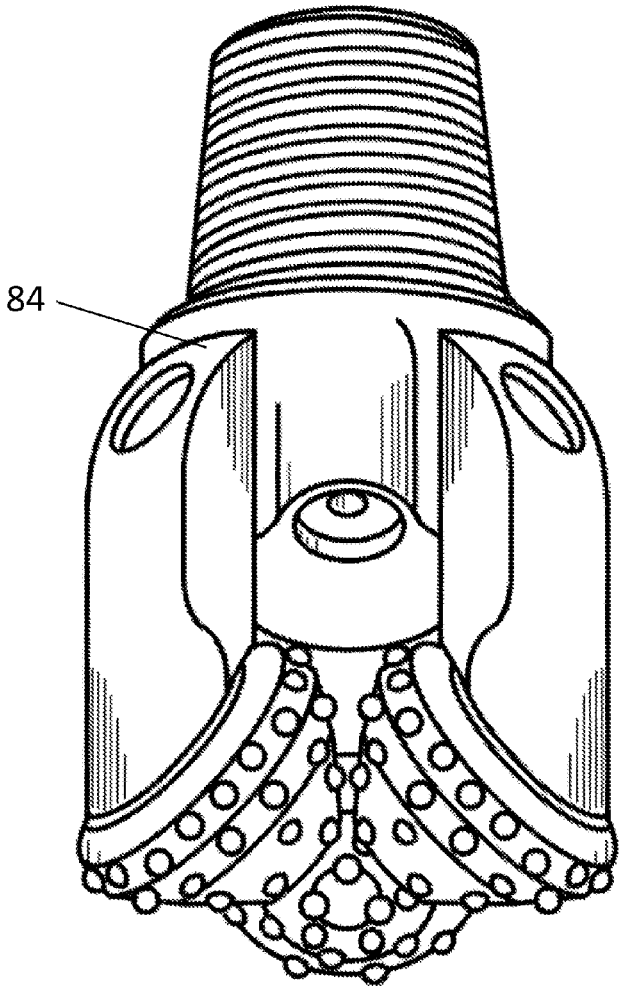
FIG. 9 shows an embodiment of a conventional rolling cutter rotary drill bit.

FIG. 9 shows a conventional rolling cutter rotary drill bit 84. Embodiments of the present invention can be used on the teeth or cutting elements or portions thereof of a rolling cutter rotary drill bit.

Advantages of the aspects of the invention include reduction of damaging consequences from vibrations and impact forces without significantly reducing the ROP of the bit. The advantages and beneficial features of the disclosed bit technology may lead to new applications where bits previously were unable to drill successfully and/or where longer runs are necessary in harsh drilling environments.

The term "void space" includes the space created by a geometry cut. The term "remaining void space" refers to the space remaining in the void space after the blade piece is inserted into the void space.

The term "decoupling cuts" includes cuts that run from the front of the blade toward the back of the blade and serve to decouple portions of the blade into segments.

The term "flex cut" includes a cut located behind the front side of a blade and between two or more decoupling cuts to form a segment. The segments reduce the blade stiffness to allow portions of the blade to act as a beam that has the capacity for limited bending from front to back.

The term "void cut" includes a cut located behind the front side of a blade and between two or more decoupling cuts to form at least one void area to provide a void space. The void cut acts to reduce the blade stiffness to allow the resulting segment of the blade to act as a beam that has the capacity for limited bending from front to back.

The term "backstop" refers to a rigid fixed part of the bit blade. The backstop acts to limit the movement, or the amount of flex, of the segments.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in combination with other vibration mitigating systems (e.g., spring activated configurations, moveable cutters/blades, or portion thereof). It will also be appreciated by those skilled in the art that the present disclosure teaches methods and processes for producing the disclosed aspects of the invention using conventional manufacturing techniques. All such techniques and similar variations apparent to those skilled in the art are deemed to be within the scope of the invention.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

What is claimed is:

1. A drill bit for subsurface drilling, comprising:

a body;

a blade extending from the body and having a front side relative to a direction of drill bit rotation, a back side relative to the direction of drill bit rotation, and a formation facing surface between the front side and the back side, wherein the blade is configured to have a plurality of cutting elements mounted thereto; and a first flex cut extending into the blade from the formation facing surface and disposed between the front side and the back side of the blade;

wherein the first flex cut is configured to allow at least a portion of the blade to flex;

wherein the blade comprises at least two blade segments capable of flexing independently of each other;

wherein the blade segments are separated by at least one decoupling cut that extends from the front side toward the back of the blade.

2. The drill bit of claim 1, wherein the trailing portion of the blade comprises a backstop that limits the amount of flex of the blade segments.

3. The drill bit of claim 1, wherein the blade comprises from 2 to 10 blade segments.

4. The drill bit of claim 1, wherein a plurality of cutting elements is mounted to each blade segment.

5. The drill bit of claim 1 wherein the first flex cut is planar.

6. The drill bit of claim 1 wherein the blade further comprises a plurality of recesses configured to receive the plurality of cutting elements;

wherein the first flex cut does not intersect any of the plurality of recesses.

7. A drill bit for subsurface drilling, comprising:

a body;

a blade extending from the body; and a backstop;

wherein the blade comprises a front side relative to a direction of drill bit rotation, a back side relative to the direction of drill bit rotation, and a formation facing surface between the front side and the back side;

wherein the blade further comprises at least one decoupling cut extending from the front side toward the back side of the blade and forming a plurality of blade segments configured to flex relative to the body;

wherein the backstop is configured to limit the amount of flex of the plurality of blade segments;

wherein each blade segment is configured to have at least one cutter mounted thereto; and wherein the blade further comprises a first flex cut disposed in the formation facing surface between the backstop and at least one blade segment.

8. The drill bit of claim 7 wherein the blade comprises a plurality of blade segments, and wherein at least one blade segment is capable of flexing independently of the other blade segments of the plurality.

9. The drill bit of claim 7 wherein each blade segment is coupled to at least one cutter.

10. The drill bit of claim 7, wherein the backstop that limits the amount of flex of the at least one blade segment to the elastic limit of the bit material.

11. The drill bit of claim 7 wherein the first flex cut has a thickness within the range of 0.005 inch to 0.100 inch.

12. The drill bit of claim 7 wherein the decoupling cut is planar.

13. A drill bit for subsurface drilling, comprising:

a body;

a blade extending from the body and having a front side relative to the direction of drill bit rotation, a back side relative to the direction of drill bit rotation, and a formation facing surface disposed between the front side and the back side; and a flex cut extending from the formation facing surface and disposed between the front side and the back side of the blade;

wherein the first flex cut is configured to allow at least a portion of the blade to flex;

wherein the blade further comprises a plurality of blade segments;

wherein at least one blade segment is capable of flexing independently of the other blade segments; and wherein each blade segment is configured to have at least one cutting element mounted thereto;

wherein the blade segments are formed by at least one decoupling cut that runs from the front side toward the back side of the blade.

14. The drill bit of claim 13 wherein the flex cut extends between two or more decoupling cuts.

* * * * *